United States Patent [19]

Silvenis

[11] Patent Number: 4,815,616

[45] Date of Patent: Mar. 28, 1989

[54] ANGLED DISPENSING CLOSURE

[75] Inventor: Scott A. Silvenis, Maudlin, S.C.

[73] Assignee: The Dow Chemical Company, Midland, Mich.

[21] Appl. No.: 161,587

[22] Filed: Feb. 29, 1988

[51] Int. Cl.[4] ..... B65D 41/04

[52] U.S. Cl. ..... 215/232; 215/235; 215/321; 215/331; 222/108; 222/517; 222/545; 222/548

[58] Field of Search ..... 215/232, 235, 321; 156/69; 222/108, 498, 517, 545, 548, 562, 568, 570

[56] References Cited

U.S. PATENT DOCUMENTS

| | | | |
|---|---|---|---|
| Re. 30,861 | 2/1982 | Krawagna | 16/DIG. 13 |
| 2,085,934 | 7/1937 | Von Till | 215/351 X |
| 3,059,816 | 10/1962 | Goldstein | 215/235 X |
| 3,833,142 | 9/1974 | Owen | 215/351 |
| 3,907,146 | 9/1975 | Fields | 215/321 X |
| 4,252,585 | 2/1981 | Raabe et al. | 156/256 X |
| 4,519,518 | 5/1985 | Wiles et al. | 215/331 |
| 4,537,318 | 8/1985 | Montgomery | 215/232 |
| 4,539,456 | 9/1985 | Mohr | 156/274.2 X |

*Primary Examiner*—Donald F. Norton

[57] ABSTRACT

A method for the alignment of a closure having a directional orifice onto a container to provide said directional orifice with a specific alignment with respect to said container as well as the resulting article are described.

10 Claims, 4 Drawing Sheets

ANGLED DISPENSING CLOSURE

BACKGROUND OF THE INVENTION

This invention relates generally to the art of dispensing closures and more particularly to a precisely oriented closure.

Mohr, U.S. Pat. No. 4,539,456 discloses an improved method of bonding cylindrical container end units to cylindrical container bodies using an induction heating system with conductors configured to produce a circumferential flow of electric current for uniform heating about the cylindrical surface. However, no adequate means has been developed for specifically orienting a closure onto its container for sealing when essential to product design; for example, a handled bottle with directional spout.

SUMMARY OF THE INVENTION

It is thus an object of this invention to provide an improved process and apparatus for attaching a closure member to a container.

It is a further object of this invention to provide a container with a directional orifice precisely aligned thereon.

It is a further and yet a more particular object of this invention to provide a process for precise alignment of closure members with regard to containers.

These as well as other objects are accomplished by providing a container with a separate closure member which is aligned in a precise rotational configuration with respect to the container and a direction orifice positioned on that closure for specific alignment with the container.

DETAILED DESCRIPTION

In accordance with this invention it has been found that a closure can be sealed to a container in a predetermined position relative to the container. In one embodiment, internal threads within the closure match external threads on the neck portion of the container. The threads on the neck portion have at least two stops which insure that the closure stops at the predetermined position. Such means of mounting a closure in a predetermined position is disclosed in U.S. Pat. No. 4,519,518 to Wiles et al. which is hereby incorporated by reference.

Figure 1:
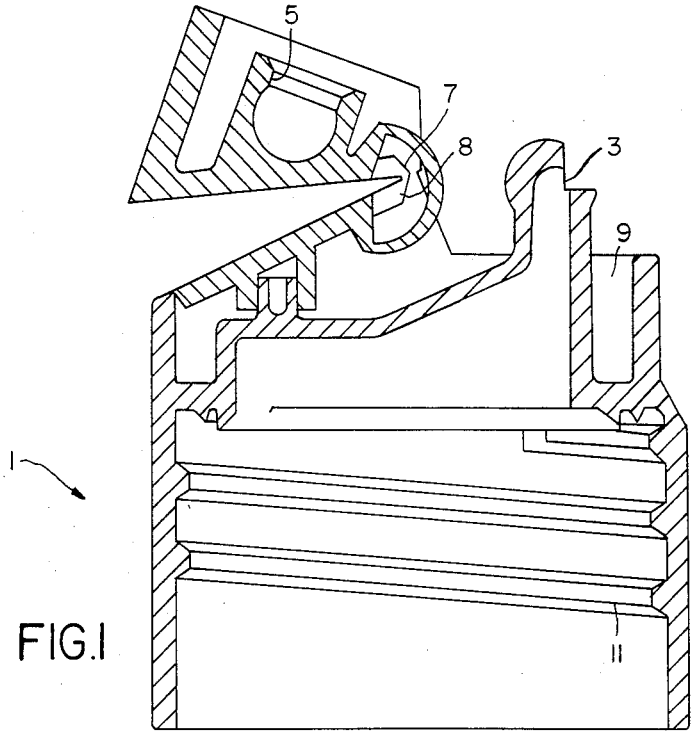
FIG. 1 is a side cross sectional view of a closure in accordance with this invention.
Figure 2:
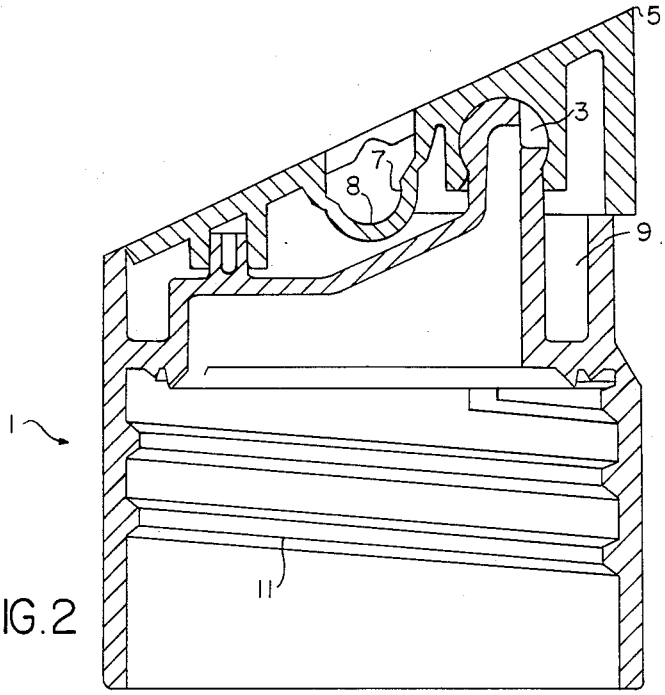
FIG. 2 is a view similar to FIG. 1 in a different orientation.
Figure 6:
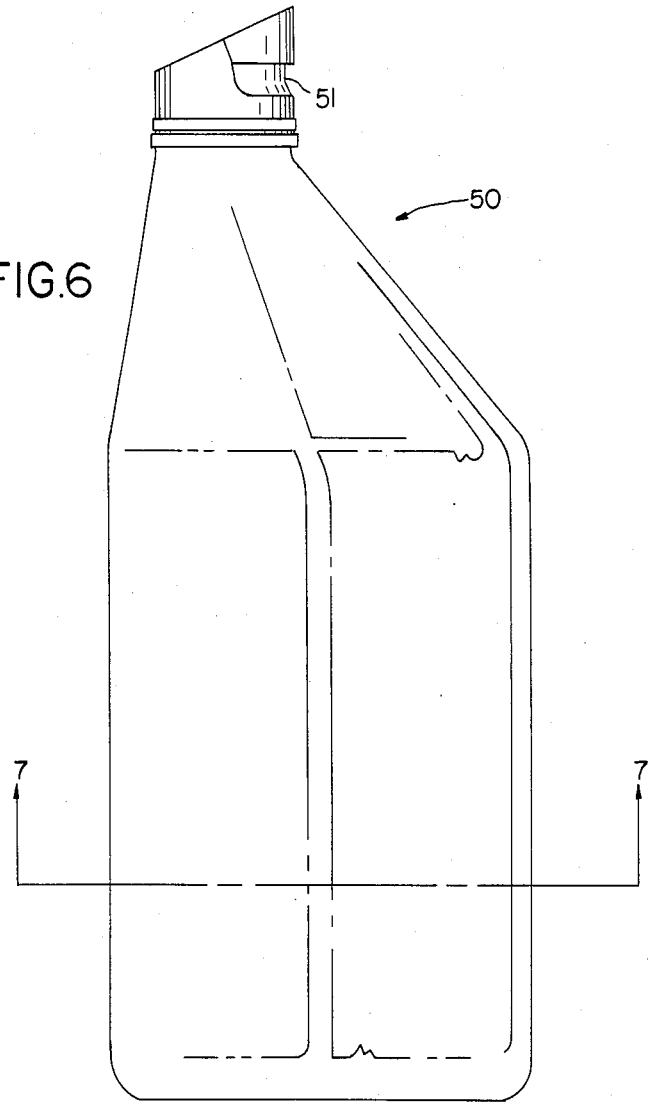
FIG. 6 is a side view of a container in accordance with this invention.

FIGS. 1, and 2, depict a threaded closure 1 which is adapted to engage a container such as that illustrated in FIG. 6. Closure 1 is open in FIG. 1 and closed in FIG. 2. Closure 1 in accordance with this invention has a directional orifice 3 covered by a snap cover 5. Snap cover 5 acts about biased hinges 7 and associated biasing element 8. Such biased hinges are taught by Krawagna in U.S. Pat. No. Re. 30,861 which is hereby incorporated by reference. Additionally closure 1 preferably has a drip well 9 to prevent excess product from dripping down the outer wall of the closure or its corresponding container, and the internal threads 11 discussed above.

Figure 3:
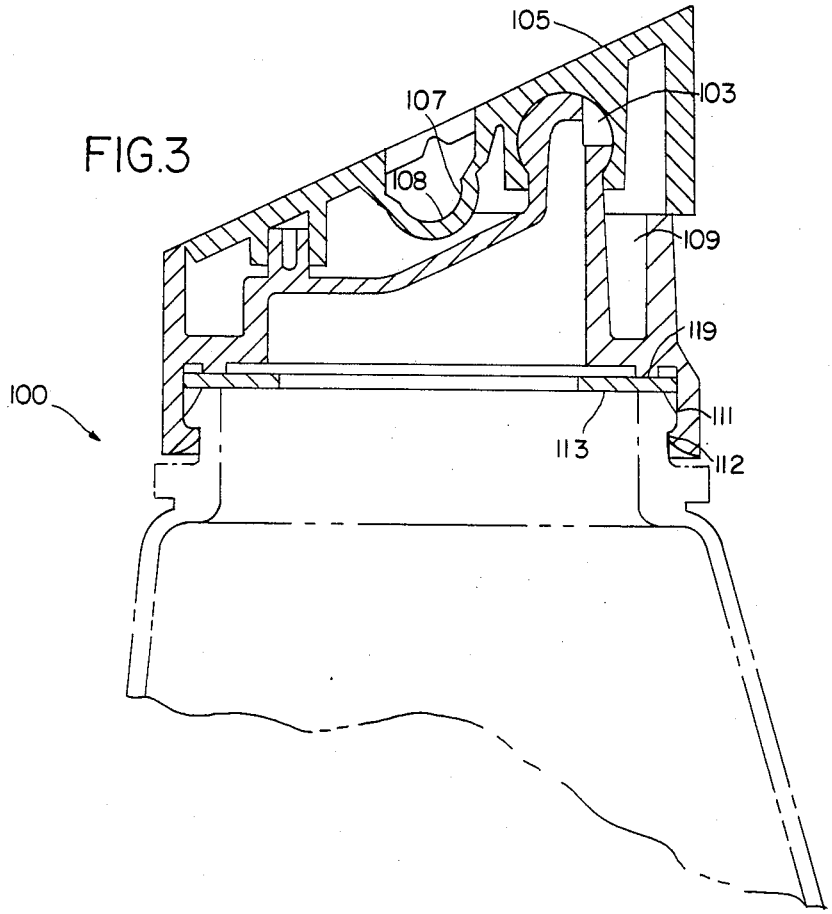
FIG. 3 is a side cross sectional view of another closure in accordance with this invention.
Figure 4:
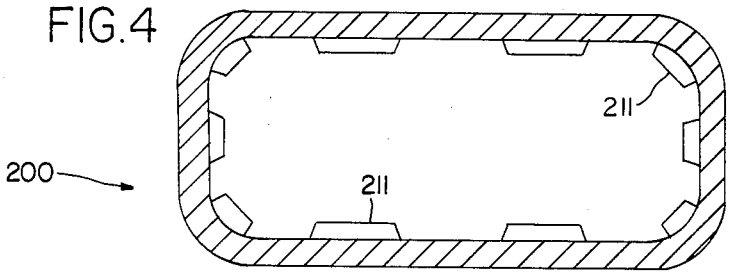
FIG. 4 is a bottom cut-away view of a closure in accordance with this invention.

A second embodiment, FIG. 3 has closure 100 with most of the same basic features as the FIG. 1 embodiment including a directional orifice 103, a snap cover 105, biased hinges 107 biasing element 108, and a drip well 109. However, rather than internal threads, this embodiment utilizes snap beads 111 to mate with snap beads 112 of a container neck. The snap beads may be a single endless line within the internal circumference of the of the closure requiring a coordinating endless line around the external circumference of a neck portion of a corresponding container or there may be a series of snap beads within the closure requiring a coordinating series of snap beads on a corresponding closure. This second possibility is especially attractive for use in a non-circular closure snapping onto non-circular container as limited alignments are possible and less material is required to produce interrupted snap beads. An internal circumference of a closure 200 having interrupted snap beads 211 is illustrated in FIG. 4.

Figure 5:
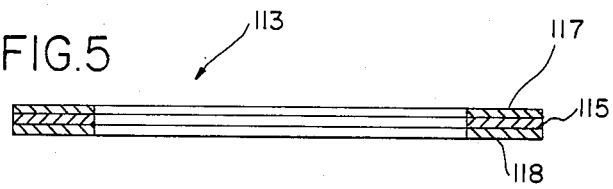
FIG. 5 is a side view of a sealing ring in accordance with this invention.

Whether continuous or interrupted, the snap beads may be used with a sealing ring, best illustrated in FIG. 5. The structure of a sealing ring 113 is illustrated in FIG. 5 as having a layer of foil 115 carried between two layers of adhesive coating 117 and 118. Ring 113 is positioned beneath a downwardly protruding internal portion 119 of closure 100, thus allowing the ring to contact an upper neck land of a corresponding container, shown in FIG. 3. A permanent seal is formed upon inductive heating of ring 115. The use of radio frequency heating to form a seal is disclosed in U.S. Pat. No. 4,252,585 to Raabe et al which is herewith incorporated by reference.

It is important to note that a seal with the upper neck land is not dependent on the internal circumference of the closure or the internal or external circumferences of the neck since the dimensions of these circumferences are difficult to precisely control with blow molded parts. A seal with the upper neck land assures consistent quality. The use of a sealing step which is subsequent to a step of positioning a closure upon a container assures that the closure can be properly oriented when sealing occurs.

Figure 7:
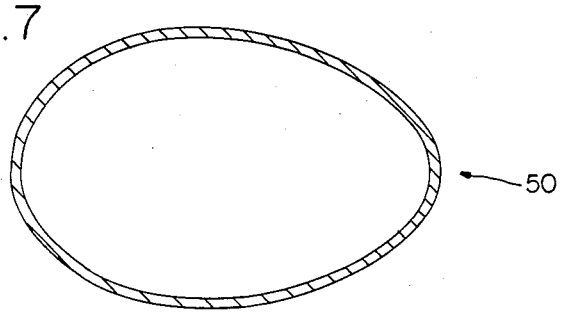
FIG. 7 is a cut-away view along the line 7—7 of FIG. 6.

FIG. 6 illustrates a container 50 in accordance with this invention. A closure noted generally as 51 in accordance with this invention is positioned upon container 50. The angle of inclination of the closure 51 together with the shape of the container greatly enhances the ability to dispense the product from the container into awkward locations. The angle of the closure may be varied as is desirable for different locations. This particular container has an egg shaped cross-section shown in FIG. 7 which is a view along the line 7—7 of FIG. 6. The side with the larger radius affords a comfortable hand grip. Thus, in this embodiment, the directional orifice is aligned opposite the hand grip to permit easy handling and dispensing. This configuration has been found to be particularly advantageous for use on toilet bowls. Optionally, the directional orifice may be aligned opposite a handle or adjacent a finger recess, not shown.

Figure 8:
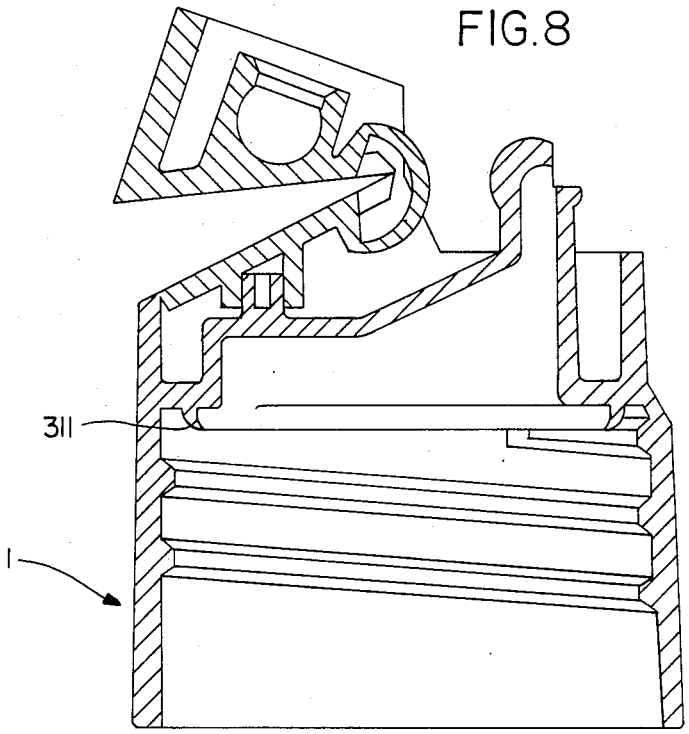
FIGS. 8 and 9 are views similar to FIG. 1 illustrating different embodiments for joining the closure with a container.
Figure 9:
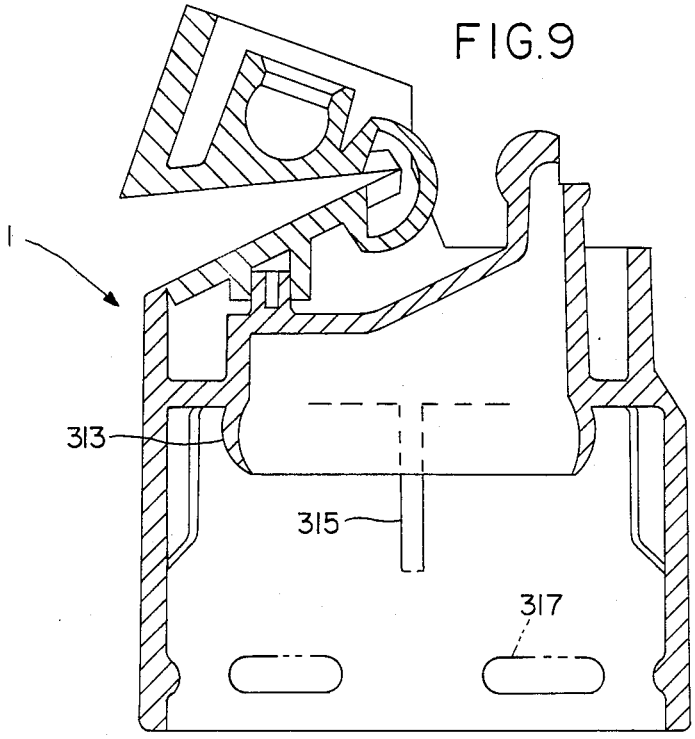

FIGS. 8 and 9 are views similar to FIG. 1 illustrating different embodiments for joining closure 1 to a container. The FIG. 8 embodiment illustrates a threaded closure similar to that of FIG. 1 but having a claw seal 311 for compression against the land of a mating container.

FIG. 9, on the other hand, illustrates a valve closure 311 which nests within the opening of a mating container. The FIG. 9 embodiment additionally illustrates alignment means 315 in the form of a rib which mates with a corresponding slot on a container so as to provide for precise alignment. Additionally illustrated in FIG. 9 are ramp-shaped beads 317 which provide for a snap-on closure. Additionally, ramp beads may be configured so as to provide a snap-on twist-off closure. Another configuration which may be provided with regard to a snap-on closure is the provision of a space between the bottom land of the closure and a section of the container to permit snap removal by the insertion of a coin beneath the beneath the bottom land of the closure.

It is thus seen that the article of this invention provides for specifically aligning a direction spout on a container requiring such a specific alignment. As various other advantages and features will be apparent to those of skill in the art from a reading of the foregoing description which is exemplary in nature, such variations are included within the spirit and scope of the invention as defined by the following appended claims.

What is claimed is:

1. An article of manufacture; comprising:

a container;

a separate closure member for said container;

means for precisely aligning said closure member with regard to said container; and a directional orifice defined by said closure member, said directional orifice being positioned in a specific alignment with respect to said container.

2. The article set forth in claim 1 wherein said means for precisely aligning the closure member with regard to said container are self-aligning threads carried on said closure member for matingly engaging threads carried by said container.

3. The article set forth in claim 1 wherein said means for aligning the closure member with regard to said container are coordinated snap beads.

4. The article set forth in claim 3 further comprising a ring with an adhesive on either side carried between said container and said closure member, said ring being capable of heating by induction heating.

5. The article set forth in claim 4 wherein said ring is carried between a downwardly protruding internal portion of said closure member and an upper neck land of said container.

6. The article set forth in claim 5 wherein said closure member is sealed onto said container by the fusion of said adhesive from induction heating of said ring.

7. The article set forth in claim 1 further including a snap cover acting about biased hinges on said closure member.

8. The article set forth in claim 1 further including a drip well on said member.

9. The article of claim 1, wherein said container has a portion to be handled, said directional orifice being in opposite alignment with said portion.

10. A process for attaching a closure member to a container comprising steps of:

providing a container and a closure member which are to be aligned in a precise rotational configuration with respect to one another, said closure member defining a directional orifice;

interposing between said container and said closure member a sealing ring having an adhesive on either side thereof and said sealing ring being capable of heating by induction heating;

positioning said closure upon said container with said ring therebetween in said precise rotational alignment to provide said directional orifice with a specific alignment with respect to said container; and inductively heating said ring to fuse said adhesive for joining said container to said closure member.

* * * * *